US006024861A

United States Patent [19]

Takeuchi et al.

[11] Patent Number: 6,024,861

[45] Date of Patent: Feb. 15, 2000

[54] ELECTRIC ANTICORROSION METHOD AND APPARATUS

[75] Inventors: Toshihiro Takeuchi; Tadashi Imanaka, both of Saitama-ken, Japan

[73] Assignee: Honda Giken Kogyo Kabushiki Kaisha, Tokyo, Japan

[21] Appl. No.: 09/147,410

[22] PCT Filed: Jul. 3, 1997

[86] PCT No.: PCT/JP97/02318

§ 371 Date: Dec. 18, 1998

§ 102(e) Date: Dec. 18, 1998

[87] PCT Pub. No.: WO98/01603

PCT Pub. Date: Jan. 15, 1998

[30] Foreign Application Priority Data

Jul. 3, 1996 [JP] Japan ..... 8-173917

[51] Int. Cl.[7] ..... C23F 13/00

[52] U.S. Cl. ..... 205/729; 205/724; 205/727; 205/728; 205/735; 205/115

[58] Field of Search ..... 205/724, 727, 205/728, 729, 735, 115; 324/71.2, 524

[56] References Cited

U.S. PATENT DOCUMENTS

| | | | |
|---|---|---|---|
| 4,755,267 | 7/1988 | Saunders | 205/726 |
| 5,324,397 | 6/1994 | Wu | 205/735 |
| 5,338,417 | 8/1994 | Brücken et al. | 205/738 |
| 5,352,342 | 10/1994 | Riffe | 205/735 |
| 5,750,071 | 5/1998 | Fiorino et al. | 205/724 |

FOREIGN PATENT DOCUMENTS

| | | |
|---|---|---|
| 61-221382 | 10/1986 | Japan . |
| 2-106465 | 8/1990 | Japan . |

*Primary Examiner*—Bruce F. Bell
*Attorney, Agent, or Firm*—Nikaido, Marmelstein, Murray & Oram LLP

[57] ABSTRACT

In an electrically corrosion-proofing process in which the polarity of a metal member having a coating film is set at negative, the duration of setting the polarity of the metal member immersed in an aqueous solution of NaCl at negative is made discontinuous, and a positive-set duration in which the polarity of the metal member is set at positive, is interposed between a proceeding negative-set duration and a succeeding negative-set duration. The switching-over of the polarity is carried out by a polarity switch-over relay between the metal member and a DC power source. In the negative-set duration, the treatment for corrosion-proofing of the metal member is carried out, but the peeling-off of the coating film from a starting point provided by a damaged portion is produced. In the positive-set duration, an electrolytic product is produced in an exposed portion of the metal member, and the peeling-off of the coating film in the next negative-set duration is prevented by the electrolytic product. Thus, it is possible to carry out the corrosion-proofing treatment of the metal member having the coating film and to inhibit the peeling-off of the coating film by the corrosion-proofing.

1 Claim, 6 Drawing Sheets

ELECTRIC ANTICORROSION METHOD AND APPARATUS

FIELD OF THE INVENTION

The present invention relates to an electrically corrosion-proofing process, and particularly, to an electrically corrosion-proofing process in which the polarity of a metal member having a coating film is set at negative, and an electrically corrosion-proofing apparatus used for carrying out the electrically corrosion-proofing process.

BACKGROUND ART

In an electrically corrosion-proofing process of this type, it is a conventional practice to set the polarity of a metal member at negative to supply electric current continuously or intermittently between the metal member and an electrode.

With this electrically corrosion-proofing process, the metal member is maintained at a high potential. For this reason, if a damaged portion reaching the metal member exists in the coating film, when electric current flows in an exposed portion of the metal member in the damaged portion, a reducing reaction occurs in the exposed portion, and hence, the corrosion of the exposed portion can be prevented.

With the conventional process, however, the following problem arises: OH ion produced by the reducing reaction reduces the adhesion force of the coating film to the metal member from a starting point provided by the damaged portion of the coating film. For this reason, the peeling-off of the coating film is produced, and the width of peeling-off of the coating film is increased substantially in proportion to the current supply time.

For example, Japanese Utility Model Application Laid-open No.2-106465 suggests a technique in which a mounting bore is provided in a metal member having a coating film which is to be brought into contact with a liquid, and an electrode is inserted into the mounting bore with a cylinder-shaped insulator interposed therebetween, whereby DC current is allowed to flow between the metal member and the electrode to provide a corrosion-proofing of a peeled-off portion produced in the coating film, and proposes that a covering member is mounted on the insulator for sealing a corner of the mounting bore in which a defect such as a pinhole is liable to be produced, from a surrounding liquid. This ensures that the corner of the mounting bore in which the electrode is mounted, can be shielded from the surrounding liquid by the covering member to prevent the peeling-off of the coating film in the corner, but this technique is not the one for effectively inhibiting the progressing of the peeling-off of the coating film produced in a portion other than the corner of the mounting bore.

Japanese Patent Application Laid-open No.61-221382 discloses the technique intended to flame-spray copper or a copper alloy onto a surface of a steel construction submerged in the sea water such as a boat or ship, and to allow DC current to flow to the steel construction and an electrode of copper or a copper alloy disposed as being opposite from the polarity of the construction, while alternately inverting the polarities of the steel construction and the electrode, thereby carrying out a corrosion-proofing treatment. More specifically, the object of this patent publication is in that in the state in which the polarity of the steel construction has been set at negative, the corrosion-proofing treatment of the steel construction is carried out, but in the state in which the polarity of the steel construction has been set at positive, copper ion is caused to be eluted from the copper-sprayed steel plate of the construction, thereby inhibiting the pollution of the copper-sprayed steel plate due to the deposition and growth of a shellfish or other sea creatures thereto by toxicity of the copper ion. This patent publication does not at all disclose a technique for effectively inhibiting the progressing of the peeling-off of the coating film of the copper or copper alloy flame-sprayed onto the steel construction, either.

DISCLOSURE OF THE INVENTION

It is an object of the present invention to provide an electrically corrosion-proofing process by which the peeling-off of the coating film on the metal member can be prevented, or the progressing of the peeling-off can be inhibited.

To achieve the object, according to the present invention, there is provided an electrically corrosion-proofing process in which a negative-set duration for setting the polarity of a metal member having a coating film at negative is made discontinuous, and a positive-set duration in which the polarity of the metal member is set at positive, is interposed between a proceeding negative-set duration and a succeeding negative-set duration, characterized in that an electrolytic product is produced on an exposed portion of the metal member by an oxidizing reaction during the positive-set duration.

In the negative-set duration, if a damaged portion reaching the metal member exists in the coating film, when electric current flows in an exposed portion of the metal member in the damaged portion, a reducing reaction occurs in the exposed portion, and hence, the corrosion of the exposed portion is prevented. On the other hand, OH ion produced by the reducing reaction reduces the adhesion force of the coating film to the metal member from a starting point provided by the damaged portion of the coating film and hence, the peeling-off of the coating film is produced.

In the positive-set duration, an electrolytic product is produced on the exposed portion of the metal member by an oxidizing reaction. The electrolytic product acts to prevent the peeling-off of the coating film in the next negative-set duration. Therefore, when one cycle is defined as a time length from the start of the negative-set duration to the end of the positive-set duration, and when the cycle is repeated, the width of peeling-off of the coating film remains at a value generated in the negative-set duration in the first cycle or at an initial stage of repetition of the cycle.

The above and other objects, features and advantages of the present invention will become apparent from the following description of the preferred embodiment taken in conjunction with the accompanying drawings.

BEST MODE FOR CARRYING OUT THE INVENTION

Figure 1:
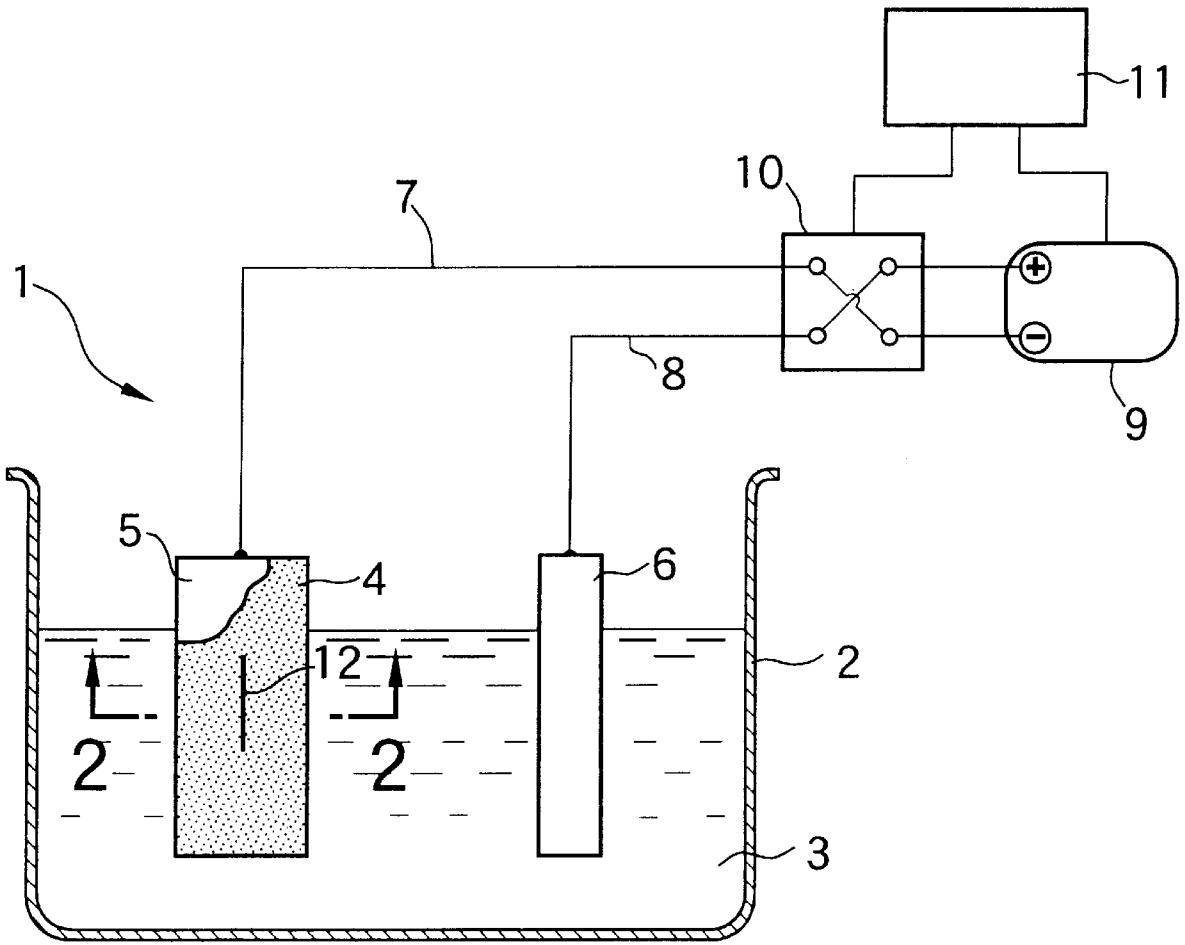
FIG. 1 is a schematic view of experimental equipment for an electrically corrosion-proofing process according to an embodiment of the present invention.

FIG. 1 shows experimental equipment 1 for an electrically corrosion-proofing apparatus. An aqueous solution 3 of NaCl is stored as an electrolytic solution in an electrolytic cell 2. A steel plate 5 as a metal member having a coating film 4 and a carbon electrode 6 as an electrode are immersed in the aqueous solution 3 of NaCl. The steel plate 5 and the carbon electrode 6 are connected to a DC power source 9 through current supply lines 7 and 8. A polarity switch-over relay 10 as a polarity switch-over means is provided in the current supply lines 7 and 8.

The DC power source 9 is controlled to a constant voltage and controlled in an ON-OFF turned manner by a control unit 11. The polarity switch-over relay 10 is controlled by the control unit 11, so that the polarity of the steel plate 5 is switched over alternately from positive to negative and vice versa. In this case, the polarity of the carbon electrode 6 is, of course, opposite from that of the steel plate 5.

Figure 2:
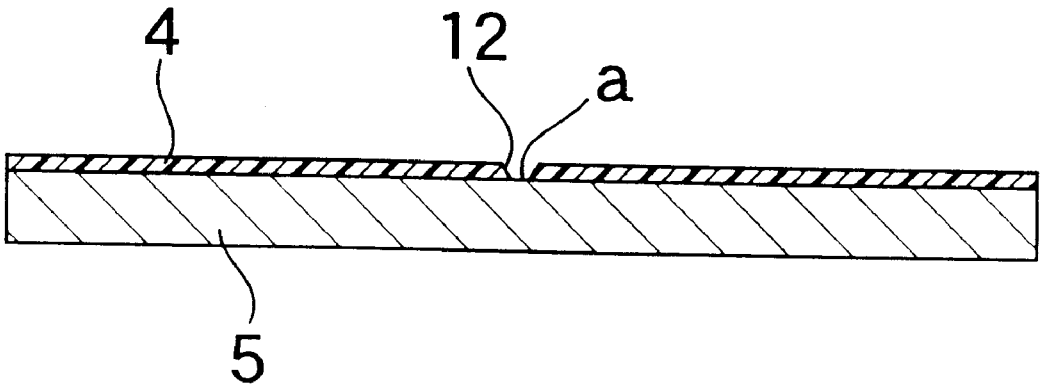
FIG. 2 is a sectional view taken along a line 2—2 in FIG. 1.

As shown in FIG. 2, the coating film 4 is formed on only one surface of the steel plate 5, and a damaged portion 12 is formed in the coating film 4 by a cutter to reach the steel plate 5.

Figure 3:
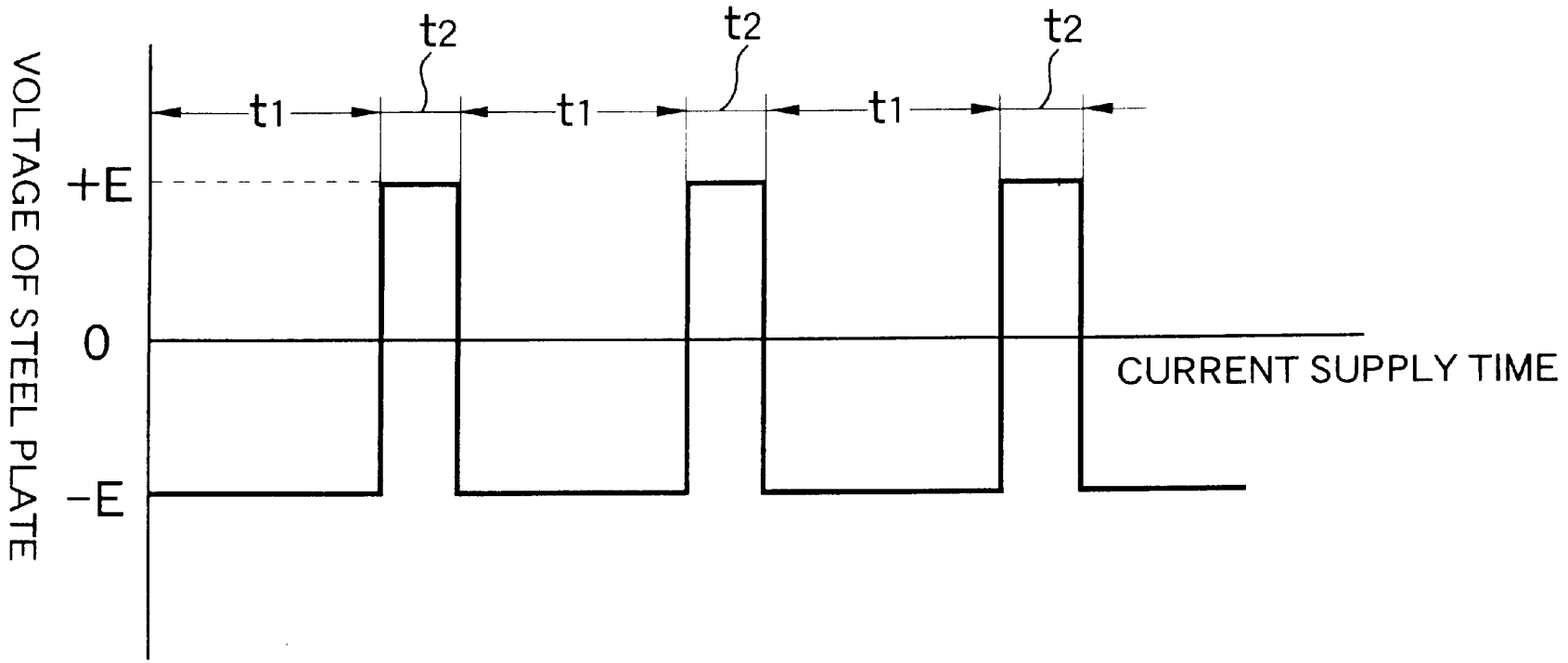
FIG. 3 is a graph showing the relationship between the current supply time and the voltage of a steel plate.

As shown in FIGS. 1 and 3, to carry out an electrically corrosion-proofing process, at first, the polarity of the steel plate 5 is set at negative, while the polarity of the carbon electrode 6 is set at positive, respectively, by the polarity switch-over relay 10, and a voltage of −E (constant) is applied to the steel plate 5. Then, when the current supply time reaches $t_1$, the polarity of the steel plate 5 is switched over to positive, while the polarity of the carbon electrode 6 is switched over to negative, respectively, by the polarity switch-over relay 10, and a voltage of +E (constant) is applied to the steel plate 5. Thereafter, when the current supply time reaches $t_2$ ($t_2 << t_1$), the polarity of the steel plate 5 is again switched over to negative. One cycle is defined as a time length from the start of a negative-set duration $t_1$ in which the polarity of the steel plate 5 is set at negative (for convenience, the current supply time is used) to the end of a positive-set duration $t_2$ in which the polarity of the steel plate 5 is set at positive (for convenience, the current supply time is used). The cycle is repeated.

Figure 4:
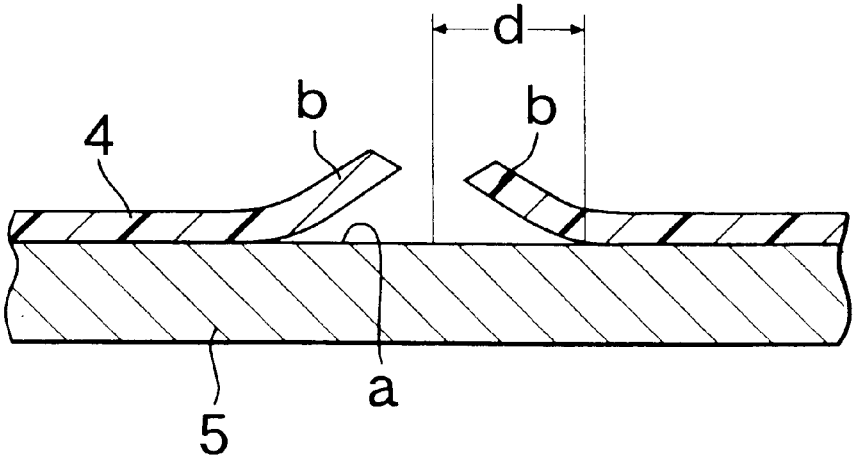
FIG. 4 is a view for explaining the peeling-off of a coating film.

In the negative-set duration $t_1$, the damaged portion 12 reaching the steel plate 5 exists in the coating film 4 and hence, when electric current flows to an exposed portion a of the steel plate 5 in the damaged portion 12, a reducing reaction occurs in the exposed portion a, and therefore, the corrosion of the exposed portion a is prevented. On the other hand, OH ion produced by the reducing reaction reduces the adhesion force of the coating film 4 to the steel plate 5 from a starting point provided by the damaged portion 12 of the coating film 4 and hence, a peeled-off portion b is produced in the coating film 4, as shown in FIG. 4.

Figure 5:
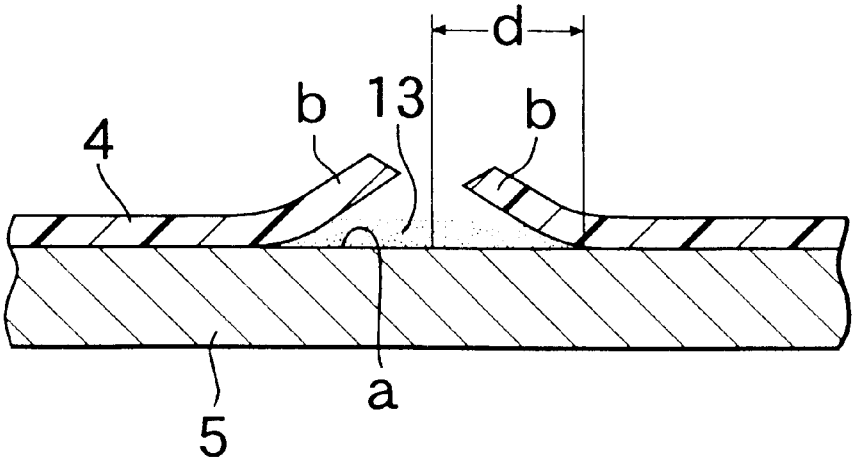
FIG. 5 is a view for explaining a state in which an electrolytic product has been produced on the steel plate.

In the positive-set duration $t_2$, an electrolytic product 13 is produced on the enlarged exposed portion a of the steel plate 5 by an oxidizing reaction, as shown in FIG. 5. The electrolytic product 13 acts to prevent the peeling-off of the coating film 4 in the next negative-set duration $t_1$. Therefore, when the cycle has been repeated, the width d of peeling-off of the coating film 4 from the damaged portion 12 remains at a value generated in the negative-set duration in the first cycle or at an initial stage of repetition of the cycle.

Particular examples will be described below.

A steel plate 5 having a width of 70 mm, a length of 150 mm and a thickness of 1 mm was subjected to a pretreatment using a pretreating agent (made under a trade name of SD2800 by Nippon Paint, Co.), and then, one surface of the steel plate 5 was subjected a cation electro-deposition to form a coating film 4 having a thickness 20 to 25 $\mu$u. Thereafter, a damaged portion 12 having a length of 50 mm was formed in the coating film 4 by use of a cutter.

Using the steel plate 5 having the coating film 4 obtained in the above manner, an electrically corrosion-proofing process was carried out, wherein a continuous supplying of electric current is conducted under conditions of a concentration of the aqueous solution of NaCl equal to 3%; a liquid temperature of 40° C.; the negative polarity of the steel plate 5; and a voltage of −8V (constant) applied to the steel plate 5. The relationship between the current supply time and the width d of peeling-off of the coating film 4 from the damaged portion 12 was examined to provide results shown in FIG. 6.

Figure 6:
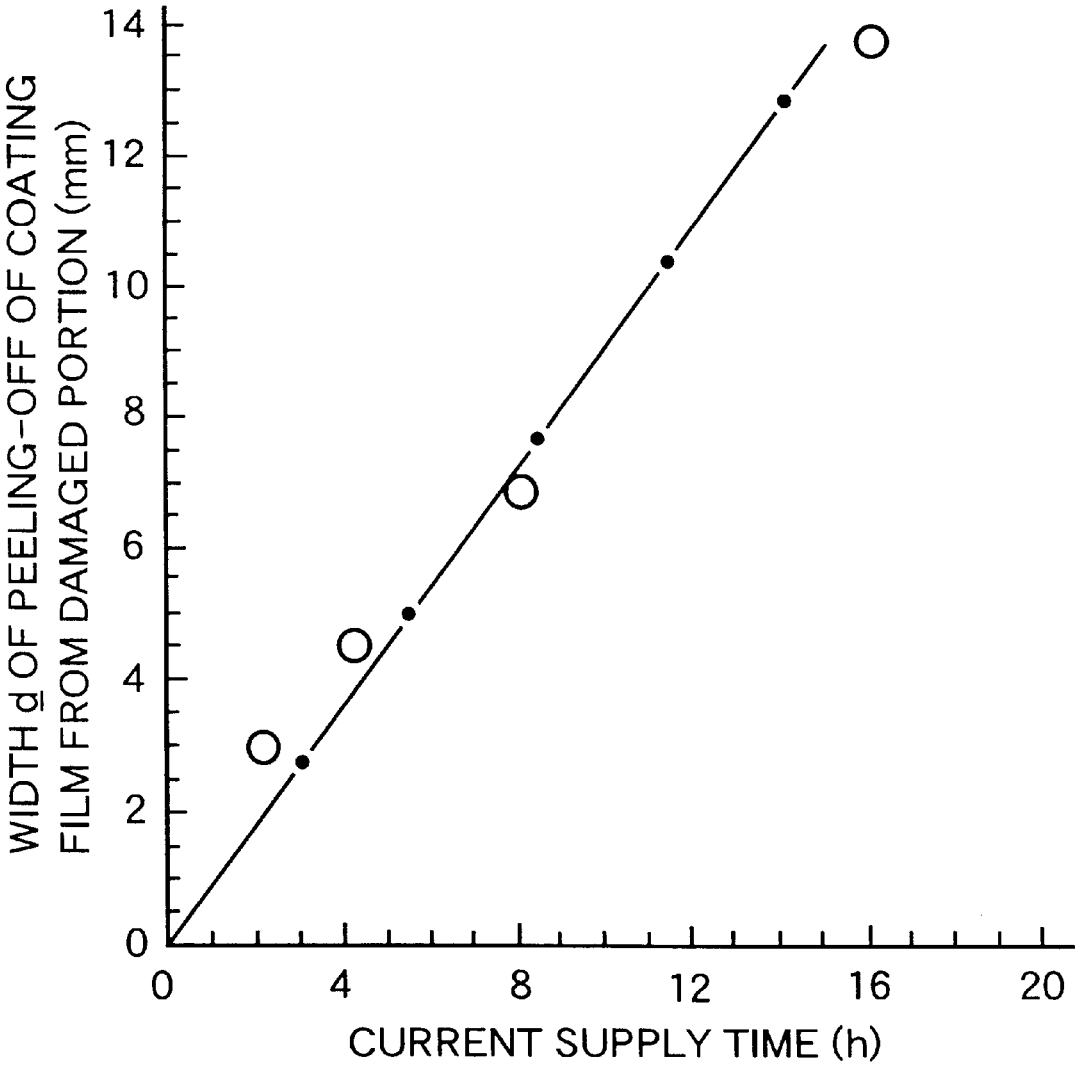
FIG. 6 is a graph showing one example of the relationship between the current supply time and the width of peeling-off of the coating film from a damaged portion.

It is apparent from FIG. 6 that the width d of peeling-off of the coating film 4 is enlarged substantially in proportion to the current supply time.

An electrically corrosion-proofing process according to the embodiment shown in FIG. 3 was carried out using the steel plate 5 having the coating film 4 similar to the above-describe steel plate 5.

Conditions in this process are as follows.

The concentration of the aqueous solution of NaCl is 3%; the liquid temperature is 40° C.; the negative-set duration: the current supply time $t_1$ is 2 hours, and the voltage is −8 V (constant); the positive-set duration: the current supply time $t_2$ is 1 minute, and the voltage is +8 V (constant); and number of repetitions of the cycle is 8.

In the carrying-out of the electrically corrosion-proofing process, the width d of peeling-off of the coating film 4 from the damaged portion 12 was measured after completion of first, second, fourth, sixth and eighth cycles.

Figure 7:
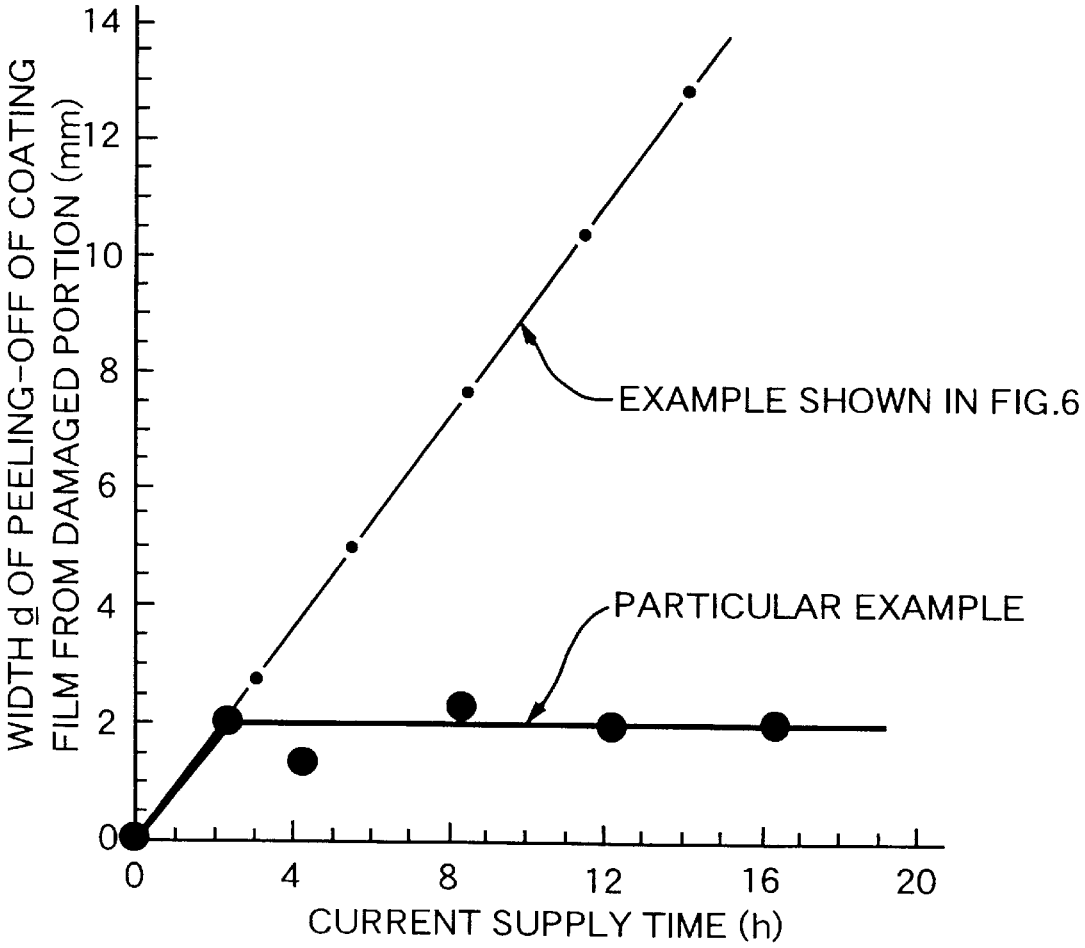
FIG. 7 is a graph showing another example of the relationship between the current supply time and the width of peeling-off of the coating film from the damaged portion.

A solid line in FIG. 7 indicates the relationship between the current supply time and the width d of peeling-off of the coating film 4 from the damaged portion 12 in the embodiment. For comparison, an example shown in FIG. 6 is indicated by a dashed line. As apparent from FIG. 7, it can be seen that in the electrically corrosion-proofing process according to the embodiment, the width d of peeling-off of the coating film 4 remains at a value d≈2 mm produced in the negative-set duration in the first cycle.

The electrically corrosion-proofing process according to the present invention is utilized for corrosion-proofing of a boat body, harbor equipment, an article burred in the ground or the like. In this case, the peeling-off of the coating film 4 starts from a pinhole, a thinner portion or the like in addition to the damaged portion.

According to the present invention, it is possible to provide an electrically corrosion-proofing process which is capable of carrying out the corrosion-proofing of a metal member having a coating film in a manner of preventing the peeling-off of the coating film or inhibiting the progressing of the peeling-off.

What is claimed is:

1. An electrically corrosion-proofing process in which a negative-set duration of setting the polarity of a metal member (5) having a coating film (4) at negative is made discontinuous, and a positive-set duration ($t_2$) in which the polarity of the metal member (4) is set at positive, is interposed between a proceeding negative-set duration ($t_1$) and a succeeding negative-set duration ($t_1$), characterized in that an electrolytic product (13) is produced on an exposed portion (a) of the metal member (5) by an oxidizing reaction during the positive-set duration ($t_2$).

* * * * *